United States Patent [19]

Hull et al.

[11] Patent Number: 4,624,113

[45] Date of Patent: Nov. 25, 1986

[54] PASSIVE-SOLAR DIRECTIONAL-RADIATING COOLING SYSTEM

[75] Inventors: John R. Hull, Hinsdale; William W. Schertz, Batavia, both of Ill.

[73] Assignee: The United States of America as represented by the United States Department of Energy, Washington, D.C.

[21] Appl. No.: 749,231

[22] Filed: Jun. 27, 1985

[51] Int. Cl.[4] ..... F25B 23/00

[52] U.S. Cl. ..... 62/467; 62/235.1; 62/264

[58] Field of Search ..... 62/264, 467, 235.1; 126/443

[56] References Cited

U.S. PATENT DOCUMENTS

| | | | |
|---|---|---|---|
| 3,043,112 | 7/1962 | Head | 62/467 |
| 3,310,102 | 3/1967 | Trombe | 62/467 |
| 4,030,316 | 6/1977 | Aronson | 62/467 |
| 4,271,681 | 6/1981 | Schertz | 62/260 |
| 4,355,522 | 10/1982 | Gorski et al. | 62/340 |
| 4,412,430 | 11/1983 | Leroy | 62/467 |

FOREIGN PATENT DOCUMENTS 239364 7/1962 Austria .

OTHER PUBLICATIONS

Granquist, C. G.: "Radiative Heating & Cooling with Selective Surfaces", Applied Optics, vol. 20, No. 15, Aug. 1981.

Granquist, C. G. et al: "Radiative Cooling to Low Temperatures: General Considerations & Application to Selectively Emitting SiO Films", J. Applied Physics, 52(6) Jun. 1981, pp. 4205–4220.

Berdahl, P. et al: "Thermal Radiance of Clear Skies", Solar Energy, 29, 299–314 (1982).

Welford et al, *The Optics of Nonimaging Concentrators*, Academic Press (1978) pp. 46–87.

*Primary Examiner*—Ronald C. Capossela

*Attorney, Agent, or Firm*—William Lohff; Michael J. Higgins; Judson R. Hightower

[57] ABSTRACT

A radiative cooling system for use with an ice-making system having a radiating surface aimed at the sky for radiating energy at one or more wavelength bands for which the atmosphere is transparent and a cover thermally isolated from the radiating surface and transparent at least to the selected wavelength or wavelengths, the thermal isolation reducing the formation of condensation on the radiating surface and/or cover and permitting the radiation to continue when the radiating surface is below the dewpoint of the atmosphere, and a housing supporting the radiating surface, cover and heat transfer means to an ice storage reservoir.

13 Claims, 3 Drawing Figures

PASSIVE-SOLAR DIRECTIONAL-RADIATING COOLING SYSTEM

CONTRACTUAL ORIGIN OF THE INVENTION

The U.S. Government has rights in this invention pursuant to Contract No. W-31-109-ENG-38 between the U.S. Department of Energy and The University of Chicago representing Argonne National Laboratory.

BACKGROUND OF THE INVENTION

This invention relates to a passive ice system and more particularly to a system using radiative cooling effective at temperatures below the dewpoint of the ambient air.

The use of seasonal ice storage for space cooling in industrial buildings and other structures is well known and has been recently emphasized in the disclosures of U.S. Pat. Nos. 4,271,681 and 4,355,522 which are incorporated herein by reference. In general, these disclosures relate to the use of cold air to make ice in a passive ice system using heat pipes and an insulated tank.

One limitation of this passive ice system is that ice formation essentially stops when ambient air temperatures are above the freezing temperature. This limitation can be partially avoided by using a substance different from water as the storage medium. An ice clathrate such as a mixture of water and freon has a freezing point that is higher than the 32° F. of pure water, with the actual temperature depending on the percentage ratio of the components. With selected clathrates, freezing temperatures in the order of 2°–5° F. above 32° F. are obtainable. However, with the conventional cooling system for ice formation, it remains important that the ambient air be at a temperature below the freezing point of the ice-forming composition.

One alternate to the limitation of ambient air temperature is to use radiative cooling. As disclosed in U.S. Pat. Nos. 3,043,112 and 3,310,102, radiative cooling has been used for direct space cooling which have not generally involved ice formation.

More particularly, the cooling systems of these references involve the rejection of heat to the 3 K (3° K.) environment of outer space mainly in the spectral region between about 8–13 microns which may be referred to as the main infrared "atmospheric window". Another window is in the wavelength region between about 19–22 microns. Selective surfaces are provided which are transparent in the region of one or more of the atmospheric windows. While these systems have advantages for direct space cooling, once the surface in contact with ambient air cools to a temperature below the dewpoint of the air, water condenses on the cold surface and effectively blocks the transmission through the window.

Accordingly, one object of the invention is a passive ice system with cooling surfaces effective at lower temperatures. A second object of the invention is a passive ice system useful for longer periods of time in making ice. Another object of the invention is a passive ice system useful in warmer climates. A further object of the invention is a passive ice system utilizing radiative cooling. Yet another object of the invention is a passive ice system utilizing radiative cooling dependent on the atmospheric window. These and other objects of the invention will become apparent from the following description.

SUMMARY OF THE INVENTION

Briefly, the invention is directed to a cold producing device with a radiating surface aimed at the sky and thermally isolated from the atmosphere. Advantageously, the device is part of a passive ice-making system including an ice storage reservoir. In the device, a transparent cover is provided over the radiating surface and is thermally isolated from the surface. The cover remains essentially free of condensation although the radiating surface may be below the dewpoint of the atmospheric air. For wavelengths within the atmospheric window, energy is emitted by the radiating surface, passes across the thermal barrier and through the outer cover, and escapes to the sky through an exit aperture. In this manner, the radiating surface may reach a temperature below the ambient temperature and may differ from the ambient air temperature by 40°–80° C.

DETAILED DESCRIPTION OF THE PREFERRED EMBODIMENT

Briefly, the invention is directed to a cold-producing device having a radiating surface for energy transfer in the wavelength region of one or more of the atmospheric windows wherein the radiating surface may be maintained below the dewpoint of the atmospheric air without condensation forming and blocking the desired radiation. Advantageously, the device includes thermally coupling means with/or for an ice-storage reservoir for making ice by cooling a heat transfer medium through the selected radiation. In particular, the cold-producing device of the invention comprises an infrared radiating body including a radiating surface aimed at the sky and capable of emitting rays within one or more wavelength bands for which the atmosphere is transparent, a cover spaced apart from the radiating surface towards the sky and transparent to said one or more wavelength bands, the cover being thermally isolated from the radiating surface to reduce the formation of condensation on the cover when the radiating surface is at a temperature below the dewpoint of the atmosphere, and a housing supporting the radiating body and cover.

Figure 2:
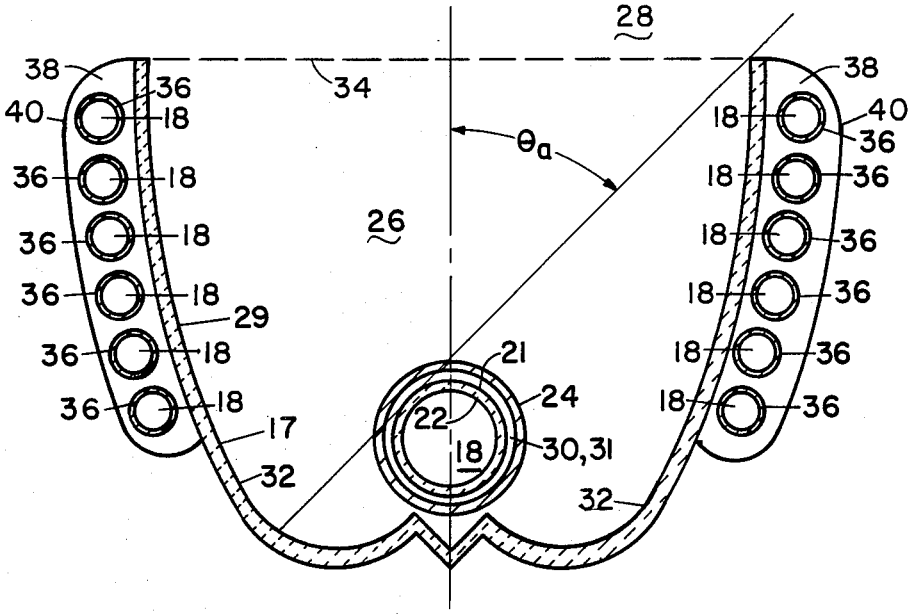
FIG. 2 is a sectional view of a radiative cooling system based on a two-dimensional CPC (compound parabolic concentrator) evacuated tube radiator.
Figure 3:
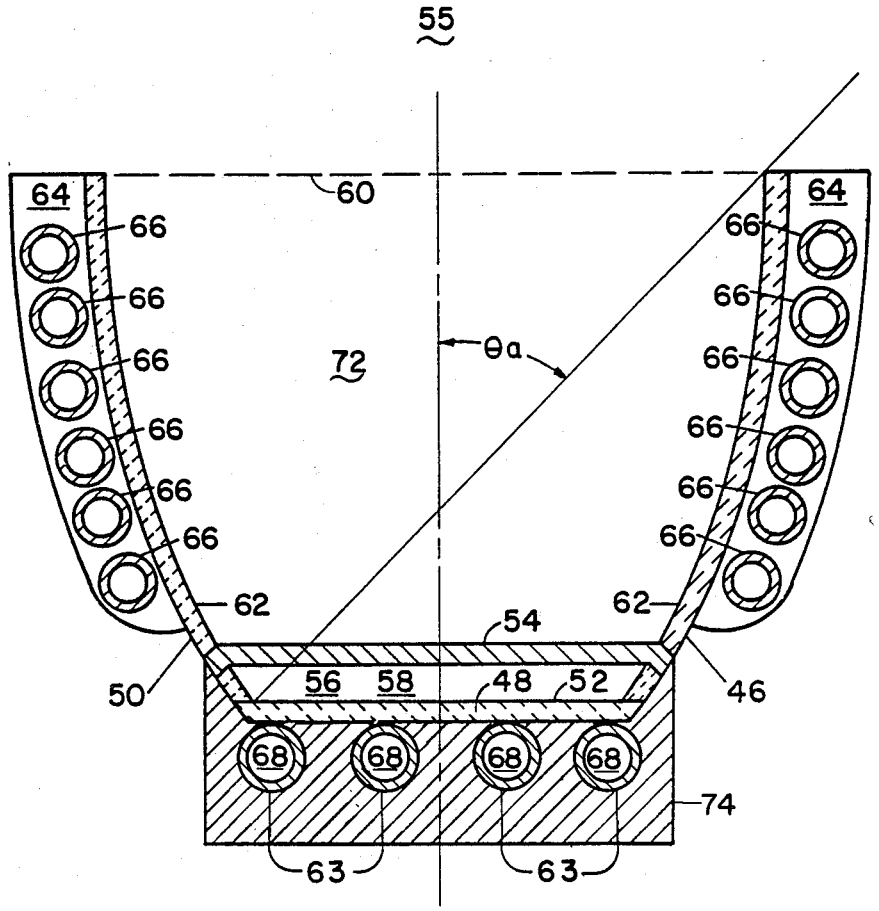
FIG. 3 is a sectional view of a second radiative cooling system based on a three-dimensional CPC (compound parabolic concentrator) evacuated tube radiator.

As illustrated in FIGS. 2–3, the housing of aluminum or similar material extends beyond the cover to an aperture having an acceptance angle below about 60° and preferably below about 45°. The housing includes a nonimaging optical system, which may use aluminum mirrors, for optically coupling the radiating surface to the sky. The housing may also include a second heat radiation system as illustrated by a plurality of fins in FIGS. 2–3.

Advantageously, the radiating surface is reflective to radiations of wavelengths for which the atmosphere is opaque or alternately, the cover may be similarly reflective. Further, the housing is advantageously opaque providing, in combination with the cover, a thermal envelope about the radiating body.

The cover is spaced apart and thermally isolated from the radiating surface so that the cover is not cooled below the dewpoint by thermal contact with the radiating surface. Preferably, the thermal barrier is provided by a vacuum with the mounting for the cover also being thermally isolated from the heat transfer portions of the housing supporting the radiating body. The use of dry gas for the thermal barrier does not provide sufficient thermal isolation to prevent condensation on the cover. Advantageously, the housing further includes means for thermally coupling the radiating body to an ice storage reservoir. Preferably, the thermal coupling means is one or more heat pipes.

The invention is particularly useful with an ice-storage system including an insulated tank for holding water to form ice in a passive ice-making system. Thermal coupling between the radiating body and ice-storage system is provided by one or more heat pipes having lower ends in contact with the water in the tank and upper ends in fluid cooling relationship with the radiative cooling system. The radiative cooling system is further characterized by a nonimaging optical system, a radiating surface capable of radiating energy in the wavelength of the atmospheric window and a cover transparent to energy of the selected wavelength. The cover is thermally isolated from the radiating surface and is exposed to atmospheric conditions to provide an ambient or near ambient temperature, thus avoiding the formation of condensation on the cover, except when the ambient air temperature is below the dewpoint.

A number of advantages are provided by this passive ice system. First, cooling temperatures below ambient are available for cooling the fluid in the heat pipes and therefore the water in the tanks. The cover over the radiating surface is in thermal contact with ambient conditions but thermally isolated from the radiating surface and therefore remains essentially at the ambient temperature.

Figure 1:
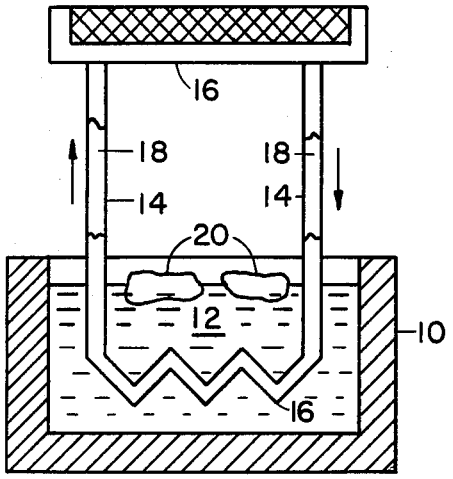
FIG. 1 is an illustration of a seasonal ice storage system using heat pipe fluid flow.

In the inventive system illustrated in FIG. 1, ice is formed in an underground storage facility illustrated by insulated tank 10. One or more heat pipes 14 extend into tank 10 in contact with the aqueous medium 12 and provide cooling surfaces 16 exposed to a cooling medium. In the desired operation, fluid 18 of freon refrigerant in heat pipe 14 is vaporized and rises to cooling surface 16 where it is cooled and condensed to form fluid 18. As fluid 18 is cooled below the freezing temperature of the aqueous medium 12, ice 20 is formed in tank 10.

FIG. 2 is a sectional view in elevation of a radiative cooling system based on a two-dimensional radiative system using a compound parabolic concentrator (CPC) for cold-producing device 17. The radiative surfaces 22 are in the shape of tube 21, of copper, aluminum, or other heat-conducting material, which provides a passage for the cooling medium 18 from the heat pipes. The radiative surfaces may be selective and emit energy only in one or more of the atmospheric window regions and reflect all other wavelengths or may be a black body. The outer cover 24 is provided as a means for isolating the radiative surfaces from the ambient temperatures. As illustrated, the cover 24 is spaced apart from the radiative surfaces 22 and serves to isolate the radiative surfaces from the ambient air 26 and the sky 28. When the radiative surfaces are selective as with a coating of titanium oxide, the cover is usually transparent to the conventional range of wavelengths and may be germanium, preferably with an antireflection coating to increase the transparency in the window region. When the radiative surfaces constitute a black body, as with a coating of flat black paint, the cover is transparent in the window region or regions and reflecting for all other wavelengths. The selective-properties of the cover are achieved by deposition of a multilayer dielectric stack, composed of thin coatings of ZnS, CdTe, ZnSe, and similar materials, on one or both sides of the cover substrate. Preferably, the cover is also reflective for wavelengths below about 3 microns.

The cover is further thermally isolated from the radiative surfaces preferably by vacuum 31 in the space 30 between the cover and surfaces. In this manner, the cover remains at or near the temperature of the ambient air while the radiative surfaces may be substantially below that temperature. This also results in the cover being essentially free of condensation except when the temperature of the ambient air is below the dewpoint.

As further illustrated in FIG. 2, housing 29 of aluminum extends beyond the radiating surface 22 towards sky 28 and provides exit aperture 34. Housing 29 includes a nonimaging system as illustrated by trough-shaped mirrors 32 of aluminum. These mirrors surround the evacuated tube forming cover 24, except for an open-surface exit aperture 34 which is aimed at the sky and covers zenith angles of under about 60° and preferably under about 45° to utilize the section of the sky with maximum transparency.

For energy with wavelengths within one or more of the atmospheric windows, energy is emitted at the radiating surfaces, passes through the cover, and escapes to the sky either directly or after one or more reflections from the mirror. Radiation with wavelengths outside the atmospheric window(s) does not participate in the effective radiative transfer since the radiating surface 22 on cover 24 is reflective to this radiation.

With nonimaging optics of the radiative system and the acceptance angle "$\theta_a$" (as defined by the mirror surface), the ratio of the exit aperture area $A_e$ with the area of the radiative surface $A_r$ may be defined as $$(ICR)_{max}=(A_r/A_e)_{max}=\sin\theta_a$$

where ICR denotes Inverse Concentration Ratio.

In the above equation, $A_r$ is proportional to the circumference of the radiating tube. Usually, for a given $A_e$, it is important to maximize $A_r$ to increase the energy radiated. At the same time, it is also important to minimize $\theta_a$ to utilize the most transparent part of the sky.

Most trough-shaped mirror geometries will limit $\theta_a$ to a useful angle. The preferred mirror geometry is the CPC design, because the maximum ICR is obtained for a given $\theta_a$.

In 2-d geometry the limitation on sky radiation acceptance only applies to the azimuthal angle (circumferentially around the tube). Radiation with longitudinal angles (with respect to the tube axis) up to 90° can impinge on the tube, and some parts of the poorly transparent sky near the horizon will be in radiative exchange with the device.

In the radiative system of FIG. 2, a second heat-radiating system is provided for cold-producing device 17 by fins 38 of aluminum through which tubes 36 of aluminum or other heat-conducting material extend. Particularly when the air temperature is sufficiently cool, fluid 18 is pumped through tubes 36 as part of the same piping system which includes tube 21 or may be separate segments of a parallel piping system. In addition to reflecting fins 38, housing 29 also supports the inner mirror surfaces 32 of the nonimaging optics. The tubes are in good thermal contact with the inner mirror surfaces 32 and the outer surface 40 of the reflecting fins 38. Both surfaces are in good thermal contact with the outside air and will be approximately at ambient temperature. The device can then significantly increase the rate of ice production when the ambient temperature drops below the freezing point.

As illustrated in FIG. 3, a cold-producing device 46 is provided with three-dimensional geometry. Device 46 includes radiating body 48 supported by housing 50 and having radiating surface 52 aimed at the sky 55. Cover 54 is spaced apart and thermally insulated from radiating surface 52. Preferably, space 56 is as a vacuum 58. Housing 50 extends beyond cover 54 towards sky 55 and forms exit opening 60. Housing 50 also includes a nonimaging mirror system as illustrated by mirrors 62. Tubes 63 and 66 provide thermal coupling between surface 52 and mirrors 62 and an ice-storage reservoir (not shown).

For device 46, the mirrors 62, optics, cover 54, and radiating surface 52 of device 46 are symmetric about the device normal. The cover and radiating surface are circular plates perpendicular to the normal, and separated by space 56 with vacuum 58. The mirrors 62 are cone-shaped or, preferably, 3-d CPCs. The use of selective surfaces 52, cover 54 and vacuum 58 is essentially the same as that for the 2-d geometry. The cooling medium 68 flows through tubes 63 of copper or other heat-conducting material below the flat cover 54 and radiative surface 52 and through tubes 66 of copper in the reflecting fins 64 which form a cone shape and supports the inner mirror surfaces 62 of the nonimaging optics. The tubes 63 are in good thermal contact with radiating body 48 and are isolated from the ambient air 72 below tubes 63 by insulation 74. The thickness of the mirrors 62 and housing 50 is small, so that the amount of heat conducted between radiating body 48 and cover 54 is negligible. As in FIG. 2, aperture 60 of FIG. 3 is aimed at the sky 55 with cover 54 isolating surface 52 from ambient air 72 and sky 55. The general design of the cover and radiative surface may be described as a three-dimensional CPC. For 3-d geometries, the equation may be represented as $$(ICR)_{max}=A_r/A_c)_{max}=\sin^2\theta_a$$

where ICR, $A_r$, $A_e$ and $\theta_a$ are as described above for the 2-d CPC of FIG. 2.

As an indication of the performance of the invention, an hour-by-hour computer simulation was carried out based on a 3-d CPC nonimaging optical system of the invention and weather data associated with an ice storage system in Dodge City, Kan. The results indicated that an inventive device based on the 3-d CPC nonimaging optical system would reject approximately 50% more heat than either a similar device without a vacuum or a flat-plate backbody radiator.

While the invention is described in connection with particular preferred embodiments, it will be understood that it is not limited to these embodiments but is intended to encompass all alternatives, modifications, and equivalents, such as devices in which the nonimaging optics deviate from the CPC geometry, as well as other modifications which may be properly included within the spirit and the scope of the invention as defined by the appended claims.

The embodiments of this invention in which an exclusive property or privilege is claimed are defined as follows:

1. A cold-producing device comprising, an infrared radiating body including a radiating surface aimed at the sky and capable of emitting rays within one or more wavelength bands for which the atmosphere is transparent, a cover spaced apart from the radiating surface towards the sky and transparent to said one or more wavelength bands, the cover being thermally isolated from the radiating surface by a vacuum to reduce the formation of condensation on the cover when the radiating surface is a temperature below the dewpoint of the atmosphere, and a housing supporting the radiating body and cover, the housing including means for thermally coupling the radiating body to an ice-storage reservoir.

2. The cold-producing device of claim 1 wherein the radiating surface is reflective to radiations of the wavelengths for which the atmosphere is opaque.

3. The cold-producing device of claim 1 wherein the cover is reflective to radiations of the wavelengths for which the atmosphere is opaque.

4. The cold-producing device of claim 1 wherein the housing extends beyond the cover towards the sky and includes a nonimaging optical system for optically coupling the radiating surface to the sky.

5. The cold-producing device of claim 4 wherein the housing includes a second heat-radiating means in addition to said radiating surface.

6. The cold-producing device of claim 5 wherein said second heat-radiating means includes a plurality of heat radiating fins.

7. The cold-producing device of claim 6 wherein the nonimaging optical system includes a trough-like mirror system attached to the radiating fins.

8. The cold-producing device of claim 7 wherein the trough-like mirror system is arranged to provide a two-dimensional compound parabolic concentrating geometry.

9. The cold-producing device of claim 8 wherein the housing includes an opening limiting the acceptance angle to less than 45 degrees.

10. The cold-producing device of claim 9 wherein the cover is reflective to radiations of wavelengths below about 3 microns.

11. The cold-producing device of claim 7 wherein the housing includes fluid passages thermally coupled to the exterior surfaces of heat-radiating fins.

12. The cold-producing device of claim 5 wherein the nonimaging optical system is composed of a cone-like mirror system attached to said radiating fins.

13. The cold-producing device of claim 12 wherein the mirror system is arranged to provide a parabolic concentrating geometry.

* * * * *